US008382225B2

(12) United States Patent
Ozawa

(10) Patent No.: US 8,382,225 B2
(45) **Date of Patent: *Feb. 26, 2013**

(54) LIQUID EJECTING APPARATUS AND METHOD OF DRIVING LIQUID EJECTING HEAD

(75) Inventor: Kinya Ozawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 216 days.

This patent is subject to a terminal disclaimer.

(21) Appl. No.: 12/699,275

(22) Filed: Feb. 3, 2010

(65) Prior Publication Data

US 2010/0194803 A1 Aug. 5, 2010

(30) Foreign Application Priority Data

Feb. 4, 2009 (JP) ..... 2009-024295

(51) Int. Cl.
*B41J 29/38* (2006.01)

(52) U.S. Cl. ..... 347/11; 347/10

(58) Field of Classification Search ..... 347/10, 347/11

See application file for complete search history.

(56) References Cited

U.S. PATENT DOCUMENTS

| | | | | |
|---|---|---|---|---|
| 6,095,630 | A * | 8/2000 | Horii et al. | 347/10 |
| 6,328,398 | B1 | 12/2001 | Chang | |
| 6,431,675 | B1 | 8/2002 | Chang | |
| 6,467,865 | B1 * | 10/2002 | Iwamura et al. | 347/14 |
| 6,764,152 | B2 | 7/2004 | Umeda et al. | |
| RE38,941 | E * | 1/2006 | Ishikawa | 347/11 |
| 7,073,878 | B2 | 7/2006 | Nishida et al. | |
| 7,513,586 | B2 | 4/2009 | Mataki | |
| 7,934,786 | B2 * | 5/2011 | Ozawa | 347/11 |
| 8,016,377 | B2 * | 9/2011 | Uraki | 347/11 |
| 2004/0017413 | A1 * | 1/2004 | Kusunoki | 347/11 |
| 2004/0212646 | A1 | 10/2004 | Nishida et al. | |
| 2006/0125856 | A1 * | 6/2006 | Kitami et al. | 347/10 |
| 2008/0106558 | A1 | 5/2008 | Azami | |

FOREIGN PATENT DOCUMENTS

| | | | |
|---|---|---|---|
| EP | 0947325 | A1 | 10/1999 |
| JP | 02-184449 | A | 7/1990 |
| JP | 3275965 | B2 | 4/2002 |
| JP | 2003-094656 | A | 4/2003 |
| JP | 2006-306076 | A | 11/2006 |
| JP | 2008-023865 | A | 2/2008 |

* cited by examiner

*Primary Examiner* — Julian Huffman
*Assistant Examiner* — Sharon A Polk
(74) *Attorney, Agent, or Firm* — Kilpatrick Townsend & Stockton LLP

(57) ABSTRACT

A liquid ejecting apparatus includes a liquid ejecting head having a pressure generating chamber which communicates with a nozzle opening for discharging a liquid and a pressure generating unit which generates a pressure variation within the pressure generating chamber; and a driving unit that supplies the pressure generating unit with a driving signal having an inflation element in which the pressure generating chamber is inflated, a contraction element in which the pressure generating chamber is contracted to discharge a liquid from the nozzle opening, and a re-inflation element in which the pressure generating chamber is inflated during the contraction element, wherein the re-inflation element is initiated in a state that two different phases of vibration of the meniscus within the nozzle opening are not opposite to each other.

6 Claims, 8 Drawing Sheets

LIQUID EJECTING APPARATUS AND METHOD OF DRIVING LIQUID EJECTING HEAD

BACKGROUND

1. Technical Field

The present invention relates to a liquid ejecting apparatus including a liquid ejecting head for ejecting a liquid from a nozzle opening and a method of driving a liquid ejecting head.

2. Related Art

An ink jet recording apparatus such as an ink jet printer or plotter includes an ink jet recording head capable of discharging ink stored in an ink storage unit, such as an ink cartridge or an ink tank, as an ink droplet.

The ink jet recording head includes a pressure generating chamber which communicates with a nozzle opening, a reservoir which is a common liquid chamber that communicates with a plurality of pressure generating chambers, and a pressure generating unit which generates a pressure variation within the pressure generating chamber to discharge a droplet from the nozzle opening. The pressure generating unit installed in the ink jet recording head may include, for example, a longitudinal vibration type piezoelectric device, a bending deformation type piezoelectric device, or a device using an electrostatic force, or a heat generating device, or the like.

Some problems occur when the ink droplet is discharged by the ink jet recording head. For example, a tail of the discharged ink droplet may be lengthened, or a very small amount of secondary ink droplets may be discharged. In this case, it is impossible to perform a high speed printing or a high frequency discharging in which a plurality of ink droplets are discharged with a rapid timing.

Therefore, JP-A-2-184449, JP-A-2006-306076, and Japanese Patent No. 3275965 discloses a contraction element for discharging an ink droplet by contracting the volume of the pressure generating chamber using a driving signal supplied to the pressure generating unit such as a piezoelectric device and an inflation element for severing an ink pole by inflating the pressure generating chamber.

However, as high-speed printing is more and more in demand, it is necessary to further shorten the tail of the ink droplet. Therefore, a method of abruptly changing the voltage by increasing the driving voltage of the inflation element to sever the ink pole, and reducing the time for applying the voltage has been proposed. However, if the voltage is abruptly changed, vibration of the meniscus of the ink within the nozzle opening after discharging the ink droplet also increases so that a secondary ink droplet may be discharged or the discharge of a subsequent ink droplet may be adversely affected.

Such a problem cannot be addressed by the patent documents described above. In addition, such a problem becomes significant when ink having a high viscosity is discharged.

Such a problem also occurs in a liquid ejecting apparatus which ejects a liquid other than ink, as well as the ink jet recording apparatus.

SUMMARY

An advantage of some aspects of the invention is to provide a liquid ejecting apparatus and a method of driving a liquid ejecting head by which high-speed discharging can be achieved by shortening the tail of the discharged droplet, and stability of the discharging can be improved.

According to an aspect of the invention, there is provided a liquid ejecting apparatus including: a liquid ejecting head having a pressure generating chamber which communicates with a nozzle opening for discharging a liquid and a pressure generating unit which generates pressure variation within the pressure generating chamber; and a driving unit that supplies the pressure generating unit with a driving signal having an inflation element in which the pressure generating chamber is inflated, a contraction element in which the pressure generating chamber is contracted to discharge a liquid from the nozzle opening, and a re-inflation element in which the pressure generating chamber is inflated during the contraction element, wherein the re-inflation element is initiated in a state that two different phases of vibration of the meniscus within the nozzle opening are not opposite to each other.

According to such an aspect of the invention, since the re-inflation element is initiated during the contraction element in a state that two phases of vibration of the meniscus within the nozzle opening are not opposite to each other, it is possible to shorten the tail of the discharged droplet and stabilize the vibration of the meniscus after discharging the droplet. Since the re-inflation element is just inserted during the contraction element, an element to sever the tail after the contraction element becomes unnecessary. Therefore, it is possible to apply a driving waveform for discharging the droplet to the pressure generating unit with a short period and implement high-speed discharge (high-frequency discharge) of the droplet.

It is preferable that the contraction element includes a first contraction element in which the pressure generating chamber is contracted, a holding element in which a volume of the pressure generating chamber that has been contracted is maintained, and a second contraction element in which the pressure generating chamber is contracted after the holding element. It is preferable that the re-inflation element is provided subsequent to the holding element, and the second contraction element contracts the volume of the pressure generating chamber that has been inflated by the re-inflation element. As a result, it is possible to allow the meniscus to initiate the re-inflation element at a predetermined timing.

It is preferable that the volume of the pressure generating chamber inflated by the re-inflation element is smaller than the volume of the pressure generating chamber inflated by the inflation element. As a result, it is possible to discharge a droplet having a short tail and suppress the meniscus from running wild using the re-inflation element.

It is preferable that liquid ejecting apparatus further includes a supply unit that supplies the liquid ejecting head with a liquid having a viscosity of 10 m·Pas or higher. As a result, it is possible to discharge a liquid having a high viscosity, which may generate a long tail in the droplet, with the tail being shortened.

According to another aspect of the invention, there is provided a method of driving a liquid ejecting head having a pressure generating chamber which communicates with a nozzle opening for discharging a liquid and a pressure generating unit which generates a pressure variation within the pressure generating chamber, wherein the pressure generating unit is driven by a driving signal including: an inflation element in which the pressure generating chamber is inflated; a contraction element in which the pressure generating chamber is contracted to discharge a liquid from the nozzle opening; and a re-inflation element in which the pressure generating chamber is inflated during the contraction element, the re-inflation element being initiated in a state that the two different phases of vibration of the meniscus within the nozzle opening are not opposite to each other.

According to such an aspect of the invention, since the re-inflation element is initiated during the contraction element in a state that two phases of vibration of the meniscus within the nozzle opening are not opposite to each other, it is possible to shorten a tail of the discharged droplet and stabilize the vibration of the meniscus after discharging the droplet. Since the re-inflation element is just inserted during the contraction element, there is no need to provide an element for severing the tail after the contraction element. Therefore, it is possible to apply a driving waveform for discharging the droplet to the pressure generating unit with a short period and implement a high-speed discharging (a high-frequency discharging) of the droplet.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described in detail.

Embodiment 1

Figure 1:
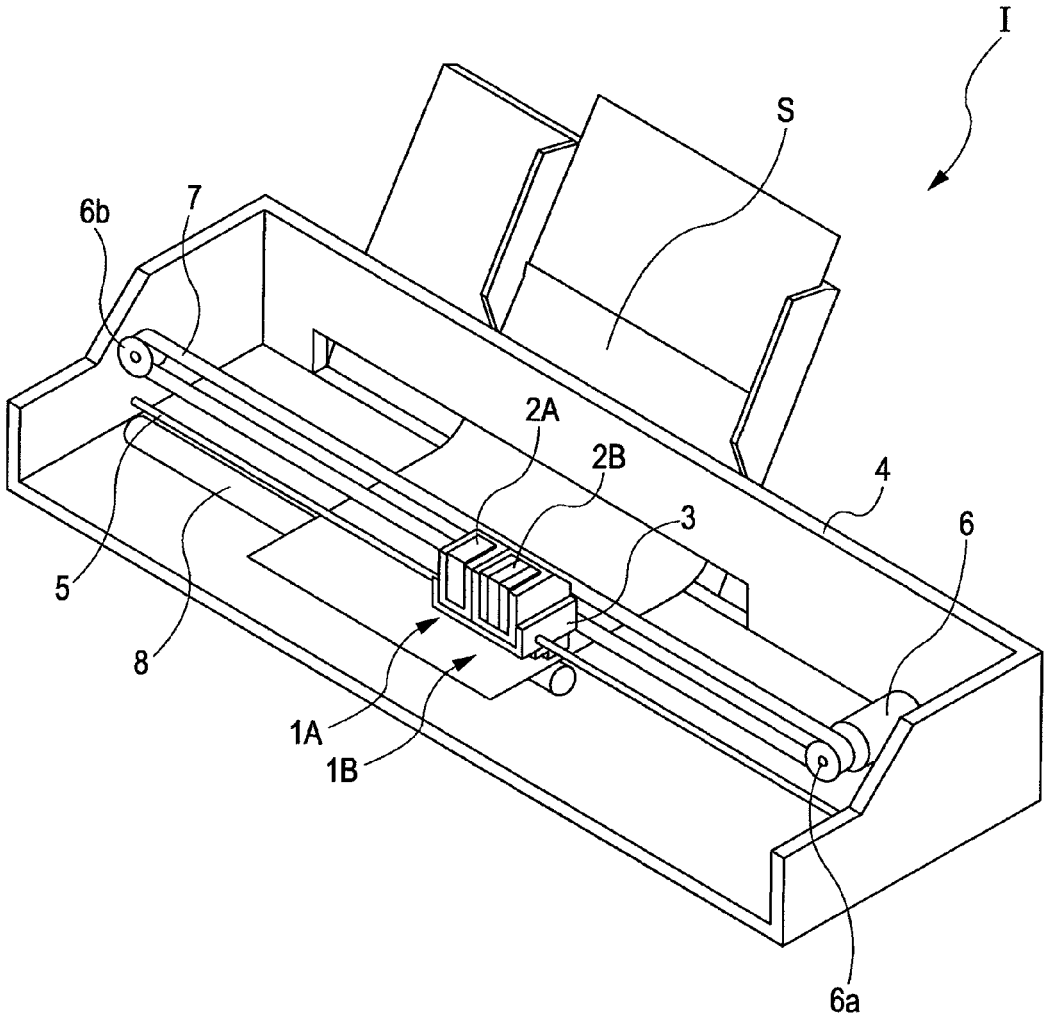
FIG. 1 is a schematic perspective view illustrating a recording apparatus according to a first embodiment of the invention.

FIG. 1 is a schematic perspective view illustrating an ink jet recording apparatus as an example of a liquid ejecting apparatus according to an embodiment of the invention.

The liquid ejecting apparatus according to the present embodiment is, for example, an ink jet recording apparatus. Referring to FIG. 1, recording head units 1A and 1B having an ink jet recording head, which will be described later, are constructed in such a way that ink cartridges 2A and 2B functioning as a supply unit for supplying inks to the ink jet recording head are detachably provided, and a carriage 3 on which these recording head units 1A and 1B are mounted is freely moved along an axial direction of a carriage axis 5 installed in the mainframe 4. These recording head units 1A and 1B are set to discharge a black ink composition and a color ink composition, respectively.

In addition, a driving motor 6 is provided in the vicinity of one end of the carriage axis 5, and a first pulley 6*a* having a trench around its circumference is provided at a leading end of an axis of the driving motor 6. Furthermore, a second pulley 6*b* corresponding to the first pulley 6*a* of the driving motor 6 is rotatably provided in the vicinity of the other end of the carriage axis 5 so that a timing belt 7 made of a ring-shape elastic member such as rubber is looped between the first and second pulleys 6*a* and 6*b*.

The carriage 3 with the recording head units 1A and 1B moves along the carriage axis 5 by transmitting a driving force of the driving motor 6 to the carriage 3 through the timing belt 7. Meanwhile, the mainframe 4 is provided with a platen 8 along with the carriage 3. The platen 8 is rotated by the driving force of the paper transport motor (not shown) so that a recording sheet S, which is a recording medium such as paper, fed from the paper feed roller is wound in the platen 8 and transported.

Figure 2:
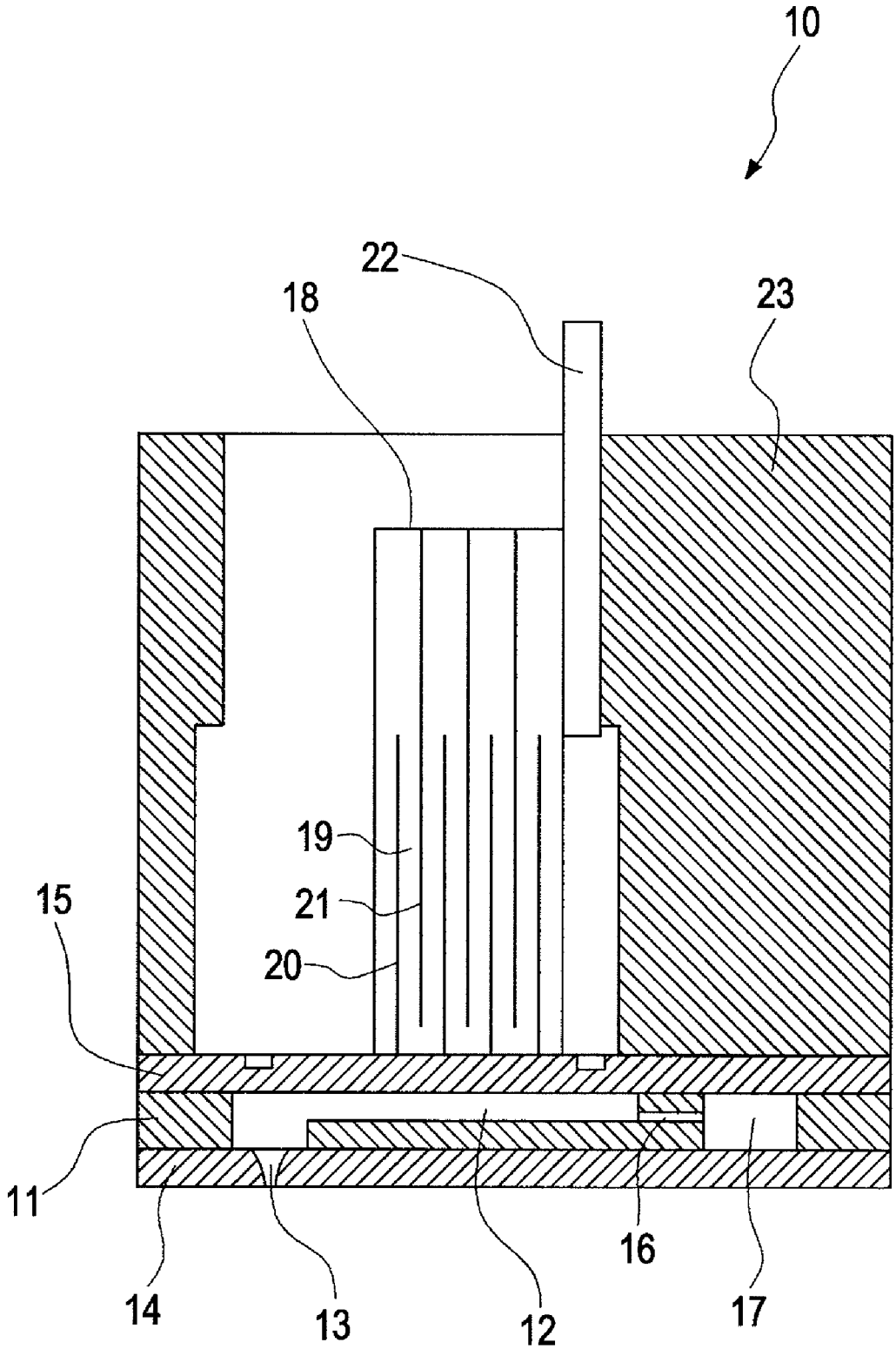
FIG. 2 is a cross-sectional view illustrating a recording head according to a first embodiment of the invention.

Hereinafter, the ink jet recording head mounted on the aforementioned ink jet recording apparatus I will be described. FIG. 2 is a cross-sectional view illustrating an exemplary ink jet recording head according to a first embodiment of the invention.

The ink jet recording head 10 shown in FIG. 2 has a longitudinal vibration type piezoelectric device. A plurality of pressure generating chambers 12 are provided in a fluid path substrate 11, and both sides of the fluid path substrates 11 are enveloped by a vibration plate 15 and a nozzle plate 14 having a nozzle opening 13 corresponding to each pressure generating chamber 12. The fluid path substrate 11 is also provided with a reservoir 17 which communicates with each pressure generating chamber 12 through each ink supply hole 16 and functions as a common ink chamber of a plurality of the pressure generating chambers 12, and an ink cartridge (not shown) is connected to the reservoir 17.

Meanwhile, in the opposite side of the pressure generating chamber 12 of the vibration plate 15, the leading ends of each piezoelectric device 18 make contact with corresponding areas of the pressure generating chamber 12. The piezoelectric device 18 is formed by erecting and stacking piezoelectric materials 19 and electrode materials 20 and 21 by turns like a sandwich, and an inactive area which does not contribute to vibration is firmly fixed to the fixed substrate 22.

In the ink jet recording head 10 constructed in this way, the ink is supplied to the reservoir 17 through an ink fluid path which communicates with the ink cartridge and distributed to each pressure generating chamber 12 through the ink supply hole 16. In practice, the piezoelectric device 18 is contracted by applying a voltage. As a result, the vibration plate 15 is deformed in association with the piezoelectric device 18 (i.e., upwardly attracted in the drawing) so that the volume of the pressure generating chamber 12 can increase, and the ink is guided into the pressure generating chamber 12. After filling the inside of the pressure generating chamber 12 with ink up to the nozzle opening 13, when the voltage applied to the electrode materials 20 and 21 of the piezoelectric device 18 is removed according to the recording signal from the driving circuit, the piezoelectric device 18 is expanded and returned to its original state. As a result, the vibration plate 15 is accordingly displaced and returned to its original state. Therefore, the pressure generating chamber 12 is contracted, and its internal pressure increases so that the ink droplet is discharged from the nozzle opening 13. That is, in the present embodiment, the longitudinal vibration type piezoelectric device 18 is provided as a pressure generating unit for generating pressure vibration in the pressure generating chamber 12.

Figure 3:
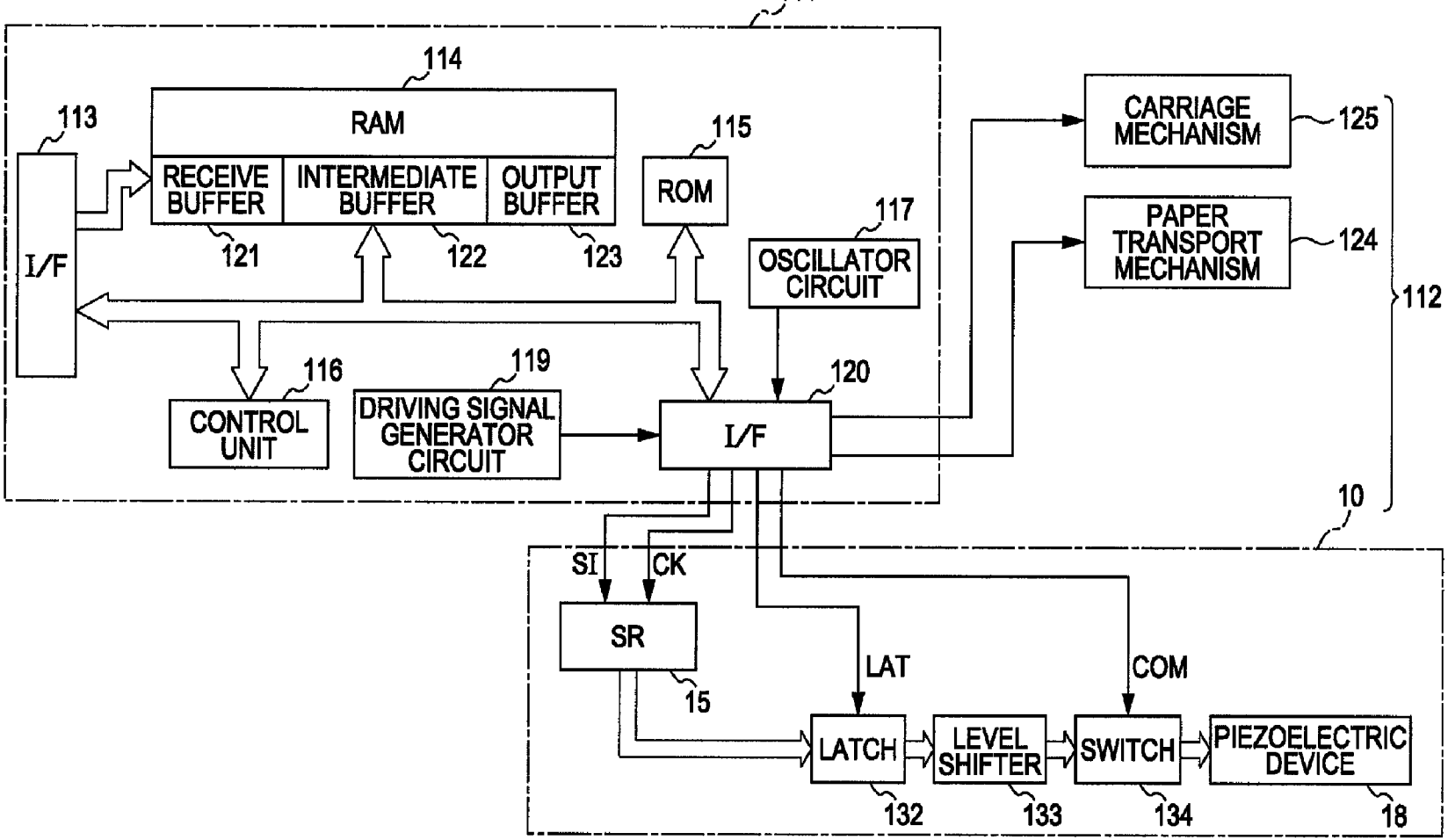
FIG. 3 is a block diagram illustrating a control construction of a recording apparatus according to a first embodiment of the invention.

FIG. 3 is a block diagram illustrating a control construction of an ink jet recording apparatus. Hereinafter, control of an ink jet recording apparatus according to an embodiment of the invention will be described with reference to FIG. 3. The ink jet recording apparatus of the present embodiment includes a printer controller 111 and a print engine 112 as shown in FIG. 3. The printer controller 111 includes an external interface 113 (hereinafter, referred to as an external I/F 113), a RAM 114 for temporarily storing various kinds of data, a ROM 115 for storing a control program or the like, a control unit 116 including a CPU, an oscillator circuit 117 for generating a clock signal, a driving signal generator circuit 119 for generating a driving signal supplied to the liquid ejecting head 10, and an internal interface 120 (hereinafter, referred to as an internal I/F 120) which transmits to the print engine 112 dot pattern data or the like (e.g., bitmap data) deployed based on the driving signal or printing data.

For example, the external I/F 113 receives print data such as character codes, graphic functions, or image data from a host computer (not shown) or the like. A busy signal BUSY or an acknowledgement signal ACK is output to the host computer or the like through the external I/F 113. The RAM 114 functions as a receive buffer 121, an intermediate buffer 122, an output buffer 123, and a work memory (not shown). The receive buffer 121 temporarily stores the print data received by the external I/F 113. The intermediate buffer 122 stores intermediate code data converted by the control unit 116. The output buffer 123 stores dot pattern data. The dot pattern data contain print data that can be obtained by decoding (translating) gradation data.

The ROM 115 stores font data, graphic functions, or the like in addition to a control program (control routine) used to execute various data processes. The control unit 116 reads the print data from the receive buffer 121 and stores the intermediate code data converted from the print data in the intermediate buffer 122. The intermediate code data read from the intermediate buffer 122 is analyzed and deployed into the dot pattern data with reference to the font data stored in the ROM 115 and graphic functions or the like. The control unit 116 executes a required decoration process and stores the deployed dot pattern data in the output buffer 123.

When the dot pattern data corresponding to a single row of the ink jet recording head 10 are obtained, they are output to the ink jet recording head 10 through the internal I/F 120. When the dot pattern data corresponding to a single row is output from the output buffer 123, the intermediate code data that have been deployed are removed from the intermediate buffer 122, and the subsequent intermediate code data are deployed.

The print engine 112 includes an ink jet recording head 10, a paper transport mechanism 124, and a carriage mechanism 125. The paper transport mechanism 124 has a paper transport motor and a platen 8 to sequentially transport the print storage medium such as recording paper in synchronization with the recording operation of the ink jet recording head 10. That is, the paper transport mechanism 124 relatively transports the print storage medium in a sub-scanning direction.

The carriage mechanism 125 includes a carriage 3 on which the ink jet recording head 10 can be mounted and a carriage driver unit which drives the carriage 3 in a main scanning direction. The ink jet recording head 10 is moved in a main scanning direction by driving the carriage 3. The carriage driver unit includes a driving motor 6 and a timing belt 7 as described above.

The ink jet recording head 10 has a plurality of nozzle openings 13 along a sub-scanning direction and discharges droplets from each nozzle opening 13 at a timing defined by the dot pattern data or the like. The piezoelectric device 18 of the ink jet recording head 10 is supplied with an electric signal such as a driving signal COM or a print data SI through external wiring (not shown). Furthermore, in the printer controller 111 and the print engine 112 constructed as described above, a printer controller 111 and a driving circuit (not shown) which includes a latch 132, a level shifter 133, a switch 134 and the like for selectively inputting to the piezoelectric device 18 a driving signal having a predetermined driving waveform output from the driving signal generator circuit 119 function as a driving unit that applies a predetermined driving signal to the piezoelectric device 18.

The shift register 131, the latch 132, the level shifter 133, the switch 134, and the piezoelectric device 18 are provided in each nozzle opening 13 of the ink jet recording head 10. The shift register 131, the latch 132, the level shifter 133, and the switch 134 are used to generate a driving pulse based on an alleviation driving signal or a discharge driving signal generated from the driving signal generator circuit 119. It is noted that the driving pulse is a pulse applied to the piezoelectric device 18 in practice.

In such an ink jet recording head 10, initially, the print data SI constituting the dot pattern data are serially transmitted from the output buffer 123 to the shift register 131 and sequentially set therein in synchronization with the clock signal CK from the oscillator circuit 117. In this case, first of all, most significant bit data of the print data corresponding to all the nozzle openings 13 are serially transmitted. When the serial transmission of the most significant bit data is terminated, second significant bit data are serially transmitted. Similarly, lower bit data are serially transmitted by turns.

When the print data of a corresponding bit for all the nozzles are set in each shift register 131, the control unit 116 outputs a latch signal LAT to the latch 132 at a predetermined timing. In response to the latch signal, the latch 132 latches the print data set in the shift register 131. The print data LATout latched by the latch 132 are applied to the level shifter 133 which functions as a voltage amplifier. The level shifter 133 boosts the print data up to a voltage value, e.g., several tens of volts that can be driven by the switch 134 when the print data is, for example, "1". The boosted print data are applied to each switch 134, and each switch 134 is allowed to have a connection state based on the corresponding print data.

Since the driving signal COM generated by the driving signal generator circuit 119 is also applied to each switch 134, the driving signal is selectively applied to the piezoelectric device 18 connected to this switch 134 when the switch 134 is selectively switched to a connection state. In this manner, it is possible to control whether or not the discharged driving signal is applied to the piezoelectric device 18 based on the print data using the exemplified ink jet recording head 10. For example, the switch 134 is in a connected state by the latch signal LAT while the print data is "1". Therefore, the driving signal COMout can be supplied to the piezoelectric device 18, and the piezoelectric device 18 is displaced (deformed) by the supplied driving signal COMout. While the print data is "0", the switch 134 is in a non-connected state. Therefore, the driving signal is not supplied to the piezoelectric device 18. While the print data is "0", each piezoelectric device 18 maintains an immediately previous voltage. Therefore, the immediately previous displacement state is maintained.

As described above, the piezoelectric device 18 is a longitudinal vibration type piezoelectric device 18. When the longitudinal vibration type piezoelectric device 18 is used, the longitudinal vibration type piezoelectric device 18 is longitudinally contracted during the electric charging so that the pressure generating chamber 12 is inflated. On the other hand, the piezoelectric device 18 is longitudinally expanded during the electric discharging so that the pressure generating chamber 12 is contracted. In such an ink jet recording head 10, the volume of the corresponding pressure generating chamber 12 varies according to the electric charging/discharging operation of the piezoelectric device 18, and thereby, the droplet can be discharged from the nozzle opening 13 using the pressure variation of the pressure generating chamber 12.

Figure 4:
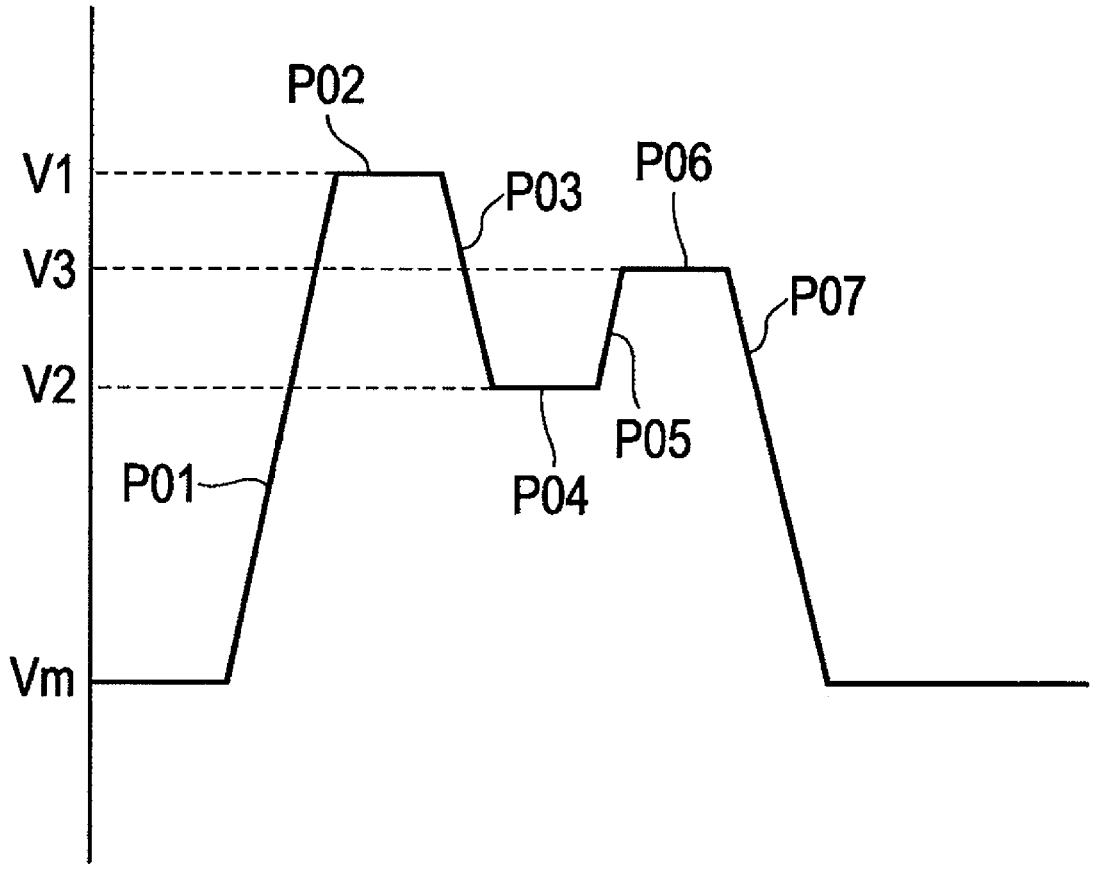
FIG. 4 is a waveform diagram illustrating a driving signal according to a first embodiment of the invention.

Hereinafter, a driving waveform representing the driving signal COM input to the piezoelectric device 18 according to an embodiment of the invention will be described. FIG. 4 illustrates a driving waveform representing the driving signal according to an embodiment of the invention.

The driving waveform input to the piezoelectric device 18 is applied to individual electrodes by setting a common electrode to a reference potential (e.g., 0 V in the present embodiment). Referring to FIG. 4, the driving waveform includes a first inflation element P01 in which a voltage level increases from the intermediate potential Vm to a first potential V1, a first holding element P02 in which the first potential V1 is maintained for a certain time, a first contraction element P03 in which a voltage level decreases from the first potential V1 to a second potential V2, a second holding element P04 in which the second potential V2 is maintained for a certain time, a re-inflation element P05 in which a voltage level increases from the second potential V2 to the third potential V3, a third holding element P06 in which the third potential V3 is maintained for a certain time, and a second contraction element P07 in which a voltage level decreases from the third potential V3 to the intermediate potential Vm.

In the present embodiment, the first contraction element P03 and the second contraction element P07 function as a contraction element for discharging the ink droplet from the nozzle opening 13 by contracting the volume of the pressure generating chamber 12.

The driving waveform has the re-inflation element P05 between the first contraction element P03 and the second contraction element P07 during the contraction element. The re-inflation element P05 is inserted while the ink droplet is discharged from the nozzle opening 13 using the contraction element. The re-inflation element P05 is initiated in a state that two different phases of vibration of the meniscus within the nozzle opening 13 are not opposite to each other as will be described later in detail. Here, "the state that two different phases of the vibration of the meniscus within the nozzle opening 13 are not opposite to each other" means a state that two different phases of the vibration of the meniscus within the nozzle opening 13 are mutually reinforced. In the state that two different phases of the vibration of the meniscus are mutually reinforced, for example, one side moves toward the discharge direction of the nozzle opening 13, and the other side also moves toward the same direction as the discharge direction. In the state that two different phases of the vibration of the meniscus are opposite to each other, for example, one side moves toward the discharge direction of the nozzle opening 13, and the other side may stop without moving toward the discharge direction or the pressure generating chamber 12.

In the present embodiment, the re-inflation element P05 is initiated in a state that the center of the meniscus of the ink within the nozzle opening 13 moves toward the discharge direction by virtue of inertial force, and the ink of the inner wall surface side within the nozzle opening 13 does not have an opposite phase to that of the center of the meniscus, i.e., at a timing that the ink of the inner wall surface side within the nozzle opening is not directed to the opposite side to the discharge direction. As described above, "the ink of the inner wall surface side within the nozzle opening 13 is not directed to the opposite side to the discharge direction" includes a state that the ink of the inner wall surface side within the nozzle opening 13 stops or a state that the ink is directed to the discharge direction of the ink droplet except for a state that the ink is directed to the pressure generating chamber 12 side.

The timing when such a re-inflation element P05 is initiated is controlled by the time of the second holding element P04. For example, if the second holding element P04 is too short, then the re-inflation element P05 is initiated in a state that two different phases of the vibration of the meniscus within the nozzle opening 13 are opposite to each other. That is, if the second holding element P04 is too short, then the center of the meniscus of the ink within the nozzle opening 13 moves in the discharge direction, and the ink of the inner wall surface side within the ink opening 13 is directed opposite to the discharge direction (toward the pressure generating chamber 12 side). In this state, if the re-inflation element P05 is input, the tail of the discharged ink droplet may be lengthened. In this regard, if the re-inflation element P05 is initiated in a state that two different phases of the vibration of the meniscus within the nozzle opening 13 are not opposite to each other by appropriately adjusting the second holding element P04, then the tail of the discharged ink droplet may be shortened.

Hereinafter, a relationship between the meniscus within the nozzle opening 13 and the driving waveform of the present embodiment will be described. FIGS. 5A to 5D and 6A to 6C are main part cross-sectional views illustrating a meniscus state of the nozzle opening.

Figure 5A:
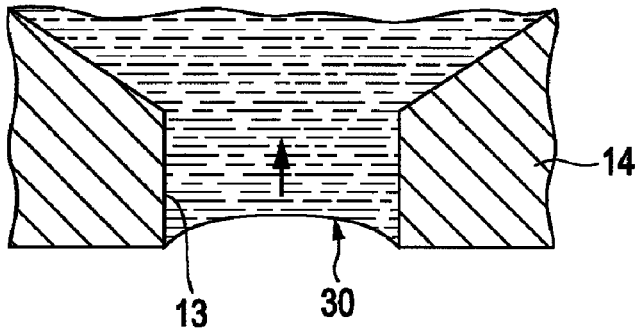
FIGS. 5A to 5D are main part cross-sectional views illustrating a state of a meniscus according to a first embodiment of the invention.

First of all, when the inflation element P01 shown in FIG. 4 is applied to the piezoelectric device 18, the piezoelectric device 18 is deformed in a direction that the volume of the pressure generating chamber 12 is inflated so that as shown in FIG. 5A, the meniscus 30 within the nozzle opening 13 is inwardly attracted to the pressure generating chamber 12, and the pressure generating chamber 12 is supplied with ink from the reservoir 17.

Figure 5B:
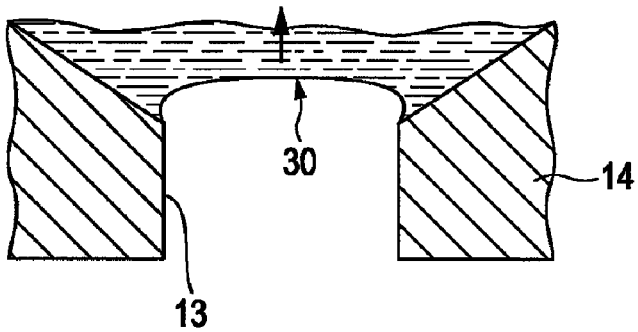

Then, when the first holding element P02 shown in FIG. 4 is applied to the piezoelectric device 18, the meniscus 30 of the nozzle opening 13 further moves toward the pressure generating chamber 12 by virtue of an inertial force as shown in FIG. 5B.

Figure 5C:
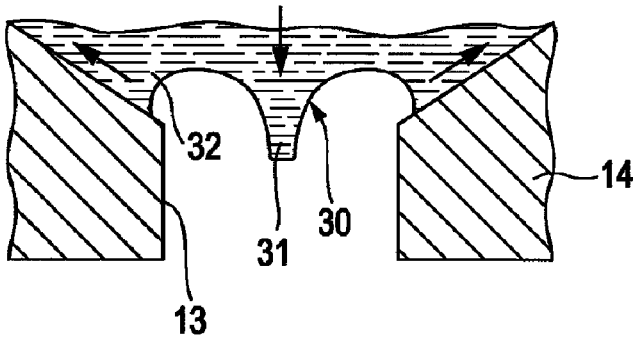

Then, when the first contraction element P03 shown in FIG. 4 is applied to the piezoelectric device 18, the piezoelectric device 18 is expanded. As a result, the pressure generating chamber 12 is abruptly contracted from the inflated volume to the contracted volume corresponding to the second potential V2, and the ink within the pressure generating chamber 12 is pressed so that the ink droplet starts to be discharged from the nozzle opening 13. That is, as shown in FIG. 5C, the center 31 of the ink meniscus 30 within the nozzle opening 13 moves in discharge direction (like a pole shape). In this case, the ink of the inner wall surface side within the nozzle opening 13 moves toward the pressure generating chamber 12 by virtue of inertial force. In other words, there is a viscosity layer (a viscosity boundary layer) 32 in the inner wall surface side of the ink within the nozzle opening 13, and the meniscus within the nozzle opening 13 has two different phases in the center and the inner wall surface (the viscosity boundary layer 32).

Figure 5D:
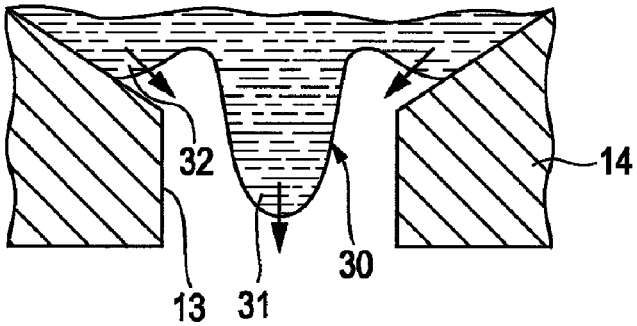

Then, when the second holding element P04 shown in FIG. 4 is applied to the piezoelectric element 18, the ink of the center 31 of the meniscus 30 within the nozzle opening 13 moves in the discharge direction (growth of the pole shape of the center 31 of the meniscus 30 within the nozzle opening 13 is promoted) as shown in FIG. 5D. The ink (the viscosity layer 32) of the inner wall surface side within the nozzle opening 13 moves in the discharge direction similar to the center 31 of the meniscus 30. As a result, two different vibration phases of the meniscus within the nozzle opening 13 are not opposite. That is, the subsequent re-inflation element P05 is initiated in a state that the ink (the viscosity layer 32) of the inner wall surface side within the nozzle opening 13, which is directed toward the pressure generating chamber 12, stops or moves in the discharge direction due to the second holding element P04.

Figure 6A:
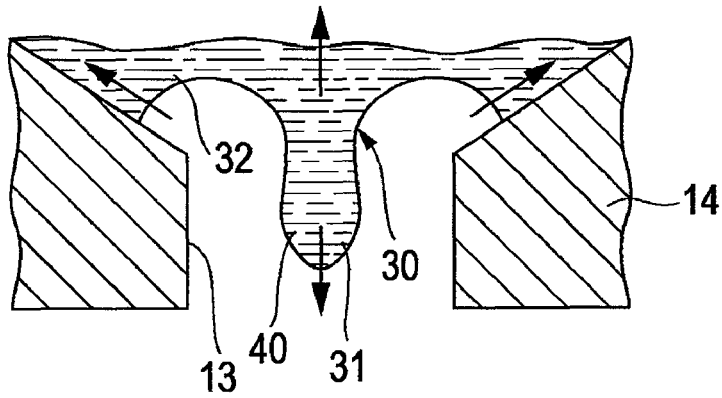
FIGS. 6A to 6C are main part cross-sectional views illustrating a state of a meniscus according to a first embodiment of the invention.

When the re-inflation element P05 shown in FIG. 4 is input to the piezoelectric device 18, both the center 31 of the ink meniscus 30 within the nozzle opening 13 and the viscosity layer 32 of the inner wall surface side move toward the pressure generating chamber 12 as shown in FIG. 6A. Since the center 31 of the meniscus 30 moves toward the pressure generating chamber 12 side as described above, a pole-shape growth portion 40 in the center 31 of the meniscus 30 moves in the discharge direction so as to be torn apart.

Figure 6B:
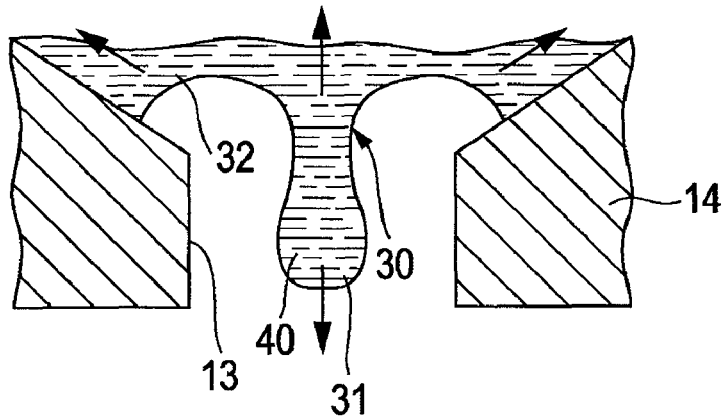
Figure 6C:
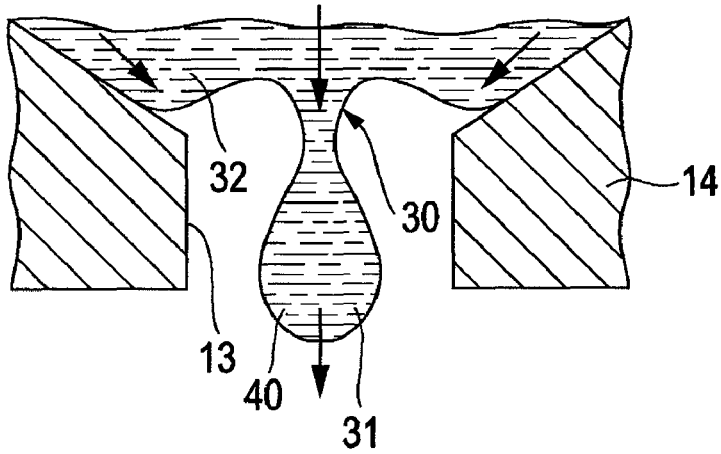

When the third holding element P06 shown in FIG. 4 is applied to the piezoelectric element 18, the center 31 of the meniscus 30 and the viscosity layer 32 of the inner wall surface side further move toward the pressure generating chamber 12 as shown in FIG. 6B, and the pole-shape growth portion 40 of the meniscus 30 starts to be separated. When the second contraction element P07 shown in FIG. 4 is applied to the piezoelectric device 18, separation of the center 31 of the meniscus 30 and the pole-shape growth portion 40 progresses as shown in FIG. 6C, and the pole-shape growth portion 40 of the meniscus is completely torn apart and discharged as an ink droplet 40. Substantially, the ink droplet 40 is discharged by the components of the third holding element P06, and the second contraction element P07 is countered with the re-inflation element P05, i.e., functions as a vibration control element for suppressing vibration of the meniscus.

Of course, the second contraction element P07 may be executed until it reaches a potential (e.g., a voltage V4) lower than the intermediate potential Vm. In this case, while the pressure generating chamber 12 is in a contracted state corresponding to the potential V4, the ink pressure within the pressure generating chamber 12 is repetitively increased and decreased according to its intrinsic vibration. Therefore, in a case where the second contraction element P07 is executed until it reaches a potential lower than the intermediate potential Vm, a vibration control element for returning to the intermediate potential Vm at the timing that the pressure of the pressure generating chamber 12 increases may be provided to return (contract) the pressure generating chamber 12 to a reference volume and absorb pressure variation within the pressure generating chamber 12.

By discharging the ink droplet 40 based on such a driving waveform, it is possible to sever the tail of the discharged ink droplet 40 and stabilize the vibration of the meniscus 30 after discharging the ink droplet 40. Since the aforementioned driving waveform includes the re-inflation element P05 between the first contraction element P03 and the second contraction element P07 which function as contraction elements for discharging the ink droplet 40, it is possible to shorten the tail of the discharged ink droplet 40 by controlling movement of the ink meniscus 30 within the nozzle opening 13. In addition, since the re-inflation element P05 is provided between the contraction elements P03 and P07, it is possible to prevent a secondary ink droplet from being discharged and stabilize the vibration of the meniscus 30 after discharging the ink droplet 40 in comparison with a case where a voltage varies from the second potential V2 to the reference potential Vm with a constant ratio is applied (a voltage variation ratio with respect to time; a slope of the waveform). In this manner, since the tail of the ink droplet 40 is shortened, and the meniscus 30 is stabilized after discharging the ink droplet 40, it is possible to steadily discharge the ink droplet 40 with the constant ink discharge characteristic without interfering with the subsequent ink droplet 40 in the tail of the discharged ink droplet 40 even when the interval until discharging the subsequent ink droplet 40 is shortened. As a result, it is possible to execute a high-speed discharging (a high-frequency discharging) of the ink droplet 40 and also a high-speed printing. In addition, since the driving waveform of the present embodiment includes only the re-inflation element P05 within the contraction element, it is possible to reduce a time (a period of the driving waveform) required to discharge a single ink droplet. Furthermore, since it is not necessary to provide a separate waveform (element) for severing the tail of the ink droplet 40 after discharging waveform for discharging the ink droplet 40, it is possible to discharge a large amount of ink droplets within a short time and implement high-speed discharging (high-frequency discharging).

It is preferable that the second potential V2 at which the first contraction element P03 is terminated, i.e., the re-inflation element P05 is initiated is set to be higher than the potential at which the second contraction element P07 is terminated, i.e., the intermediate potential Vm. This is because, if the second potential V2 at which the first contraction element P03 is terminated is set to be lower than the intermediate potential Vm at which the second contraction element P07 is terminated, then the meniscus may run wild within the nozzle opening 13 so that the tail of the ink droplet cannot be severed shortly, and a secondary ink droplet may be discharged.

In addition, it is preferable that the third potential V3 at which the re-inflation element P05 is terminated is set to be lower than the first potential V01 at which the first contraction element P03 is initiated. This is because, if the third potential V3 at which the re-inflation element P05 is terminated is high, then the meniscus may run wild within the nozzle opening 13 so that the tail of the ink droplet cannot be severed shortly, and a secondary ink droplet may be discharged.

EXAMPLE 1

Ink having a viscosity of 30 m·Pas was discharged by driving the aforementioned ink jet recording head 10 using the driving waveform (the driving signal) according to the first embodiment.

COMPARISON EXAMPLE 1

Figure 7:
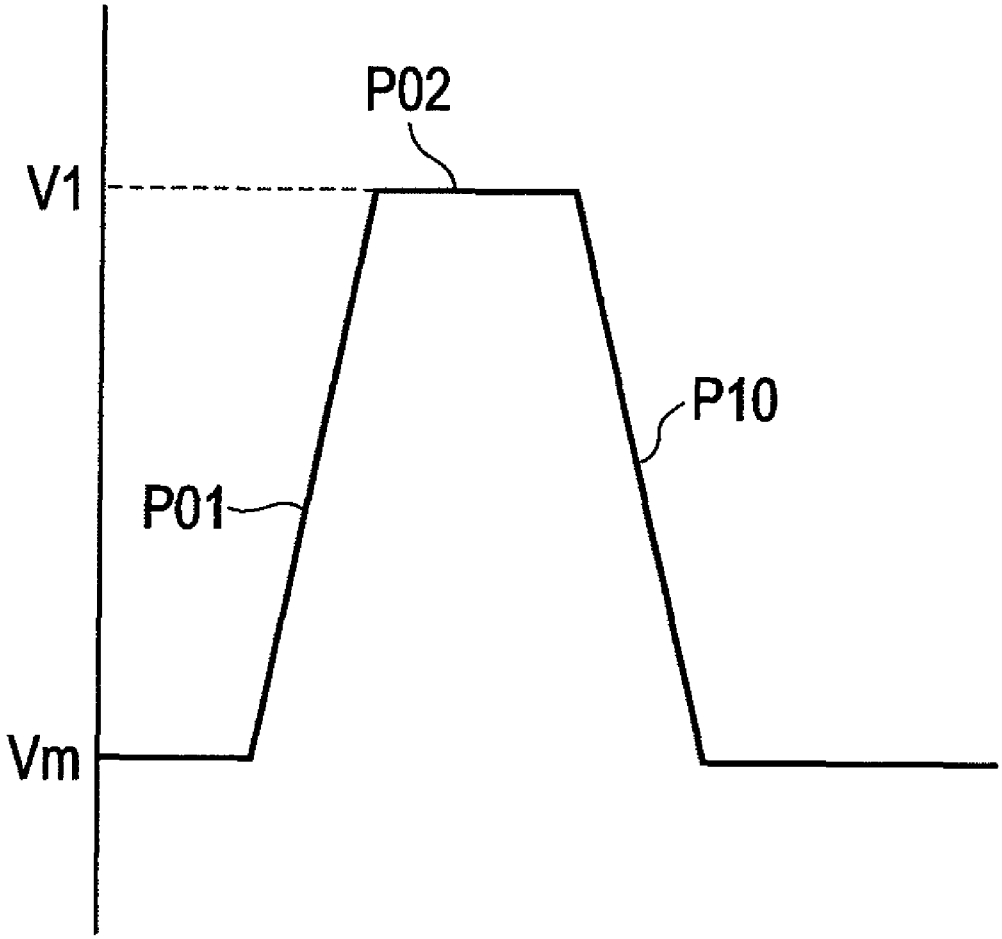
FIG. 7 is a waveform diagram illustrating a driving signal according to a first embodiment of the invention.

Ink having a viscosity of 30 m·Pas was discharged by driving the ink jet recording head 10 similar to that of the first embodiment using the driving waveform shown in FIG. 7.

The driving waveform of the comparison example 1 shown in FIG. 7 has the first inflation element P01 and the first holding element P02 similar to those of the first embodiment. In addition, the driving waveform of the comparison example 1 has a contraction element P10 for dropping a driving voltage from the first potential V1 to the intermediate potential Vm after the first holding element P02.

Figure 8A:
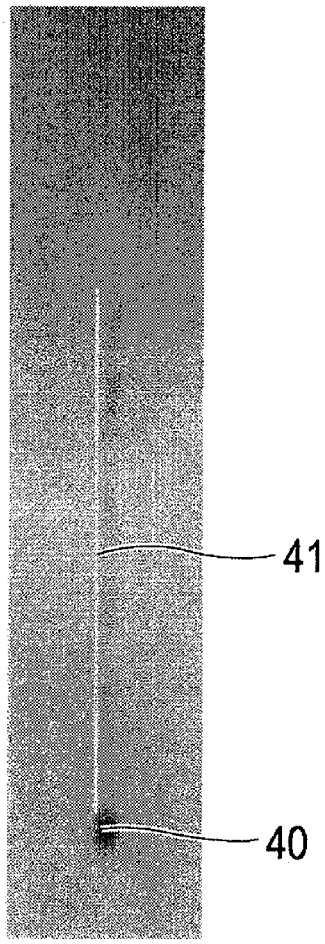
FIGS. 8A and 8B are photographs showing conditions of discharged ink droplets.
Figure 8B:
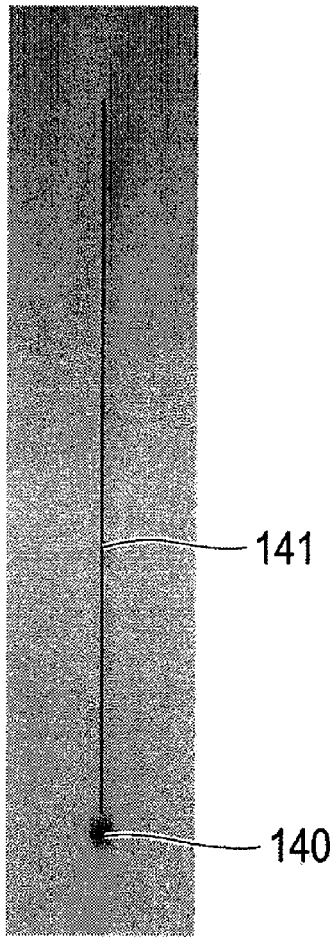

Then, conditions of the ink droplets discharged according to the example 1 and the comparison example 1 were photographed. The results are shown in FIGS. 8A and 8B. FIG. 8A shows a condition of the ink droplet according to the example 1, and FIG. 8B shows a condition of the ink droplet according to the comparison example 1.

As shown in FIG. 8A, the tail 41 of the ink droplet 40 discharged based on the driving waveform according to the example 1 is shorted than the tail 141 of the ink droplet 140 discharged based on the driving waveform according to the comparison example 1 shown in FIG. 8B.

As readily understood from this result, it is possible to shorten the tail 41 of the ink droplet 40 by using the driving signal according to the invention.

Other Embodiments

While an embodiment of the invention has been described, a basic construction of the invention is not limited thereto. For example, the aforementioned driving signal may include a minute-vibration pulse which minutely vibrates the piezoelectric device 18 so as not to discharge the ink droplet. In addition, the minute-vibration pulse may include a trapezoidal pulse having a trapezoidal waveform.

While the longitudinal vibration type piezoelectric device 18 is used as the pressure generating unit in the first embodiment, the invention is not limited thereto. For example, a bending deformation type piezoelectric device formed by laminating a lower electrode, a piezoelectric material layer, and an upper electrode may be used. Specifically, when the longitudinal vibration type piezoelectric device 18 is used, the piezoelectric device 18 is longitudinally contracted by an electric charging to inflate the pressure generating chamber 12, whereas the piezoelectric device 18 is longitudinally expanded by an electric discharging to contract the pressure generating chamber 12. On the other hand, when the bending deformation type piezoelectric device is used as the pressure generating unit, the piezoelectric device is deformed toward the pressure generating chamber 12 by the electric charging to contract the pressure generating chamber 12, whereas the piezoelectric device is deformed toward an opposite side to the pressure generating chamber 12 by the electric discharging to inflate the pressure generating chamber 12. The driving signal used to driving this type of piezoelectric device has an inverted potential polarity with respect to the aforementioned driving signal.

In addition, an electrostatic actuator which generates a static electricity between a vibration plate and an electrode and discharges the droplet from the nozzle opening 13 by deforming the vibration plate by virtue of an electrostatic force may be used as the pressure generating unit.

While the ink jet recording head 10 (head units 1A and 1B) is mounted on the carriage 3 and moves along a main scanning direction in the aforementioned ink jet recording apparatus I, the invention is not limited thereto. For example, the present invention may be applicable to a so called line-by-line type recording apparatus in which the printing is carried on just by moving a recording sheet S, such as paper, in a sub-scanning direction while the ink jet recording head 10 is fixed.

Furthermore, the invention is widely applicable to a general liquid ejecting head. For example, the invention may also be applied to a variety of ink jet recording heads such as an ink jet recording head used in an image recording apparatus such as a printer, a color material ejecting head used to manufacture a color filter of a liquid crystal display, an electrode material ejecting head used to manufacture an electrode of an organic EL (electroluminescent) display or a FED (field emission display), and a biological organic material ejecting head used to manufacture a biochip. Needless to say, the invention may also be applicable to liquid ejecting apparatus having such liquid ejecting heads without limitation.

The entire disclosure of Japanese Patent Application No. 2009-024295, filed Feb. 4, 2009 is expressly incorporated by reference herein.

What is claimed is:

1. A liquid ejecting apparatus comprising:

a liquid ejecting head comprising a pressure generating chamber which communicates with a nozzle opening for discharging a liquid, and a pressure generating unit which generates a pressure variation within the pressure generating chamber; and a driving unit that supplies the pressure generating unit with a driving signal, comprising:

an inflation element, in which the pressure generating chamber is inflated;

a contraction element, in which the pressure generating chamber is contracted to discharge a liquid from the nozzle opening; and a re-inflation element in which the pressure generating chamber is inflated during the contraction element;

wherein the re-inflation element is initiated in a state in which two different phases of vibration of a meniscus within the nozzle opening are not opposite to each other.

2. The liquid ejecting apparatus according to claim 1, wherein the contraction element comprises a first contraction element in which the pressure generating chamber is contracted, a holding element in which a volume of the contracted pressure generating chamber is maintained, and a second contraction element in which the pressure generating chamber is contracted after the holding element, and wherein the re-inflation element is provided subsequent to the holding element, and the second contraction element contracts the volume of the pressure generating chamber that has been inflated by the re-inflation element.

3. The liquid ejecting apparatus according to claim 1, wherein a volume of the pressure generating chamber inflated by the re-inflation element is smaller than a volume of the pressure generating chamber inflated by the inflation element.

4. The liquid ejecting apparatus according to claim 1, further comprising a supply unit that supplies the liquid ejecting head with a liquid having a viscosity of 10 m·Pas or higher.

5. A method of driving a liquid ejecting head comprising a pressure generating chamber which communicates with a nozzle opening for discharging a liquid, and a pressure generating unit which generates a pressure variation within the pressure generating chamber, comprising driving the pressure generating unit by a driving signal, wherein driving the pressure generating unit by the driving signal comprises:

inflating the pressure generating chamber;

contracting the pressure generating chamber to discharge a liquid from the nozzle opening; and re-inflating the pressure generating chamber during the contracting, the re-inflating being initiated in a state in which two different phases of vibration of a meniscus within the nozzle opening are not opposite to each other.

6. A liquid ejecting apparatus comprising:

a liquid ejecting head comprising a pressure generating chamber which communicates with a nozzle opening for discharging a liquid, and a pressure generating unit which generates a pressure variation within the pressure generating chamber; and a driving unit that supplies the pressure generating unit with a driving signal, comprising:

an inflation element, in which the pressure generating chamber is inflated;

a first contraction element, in which the pressure generating chamber is contracted to discharge a liquid from the nozzle opening;

a re-inflation element in which the pressure generating chamber is inflated; and a second contraction element, in which the pressure generating chamber is contracted to discharge the liquid from the nozzle opening;

wherein the re-inflation element is subsequent to the first contraction element and prior to the second contraction element, and where in the re-inflation element is initiated in a state in which two different phases of vibration of a meniscus within the nozzle opening are not opposite to each other.

* * * * *